US008732876B2

(12) United States Patent
Lachenbruch et al.

(10) Patent No.: US 8,732,876 B2
(45) Date of Patent: May 27, 2014

(54) UPPER BODY SUPPORT MECHANISM

(75) Inventors: Charles A. Lachenbruch, Lakeway, IN (US); Christopher R. O'Keefe, Batesville, IN (US); Rachel Williamson, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 573 days.

(21) Appl. No.: 12/892,977

(22) Filed: Sep. 29, 2010

(65) Prior Publication Data

US 2012/0073051 A1 Mar. 29, 2012

(51) Int. Cl.
*A61G 13/04* (2006.01)

(52) U.S. Cl.
USPC ..... 5/621; 5/622; 5/623; 5/646; 5/424; 5/662; 5/620

(58) Field of Classification Search
USPC ..... 5/602, 621–623, 646, 424, 658, 662, 5/620
See application file for complete search history.

(56) References Cited

U.S. PATENT DOCUMENTS

| | | | | | |
|---|---|---|---|---|---|
| 1,279,120 | A | * | 9/1918 | Kellogg | 607/115 |
| 3,100,129 | A | * | 8/1963 | Adolphson | 297/423.22 |
| 4,247,091 | A | * | 1/1981 | Glowacki et al. | 5/602 |
| 4,426,071 | A | * | 1/1984 | Klevstad | 5/602 |
| 4,541,622 | A | * | 9/1985 | Tabuchi | 5/602 |
| 4,650,249 | A | | 3/1987 | Serber | |
| 4,834,457 | A | | 5/1989 | Head | |
| 5,060,327 | A | * | 10/1991 | Celestina et al. | 5/662 |
| 5,131,106 | A | * | 7/1992 | Jackson | 5/613 |
| 5,487,590 | A | * | 1/1996 | Haynes | 297/344.14 |
| 5,600,857 | A | | 2/1997 | Heilmann | |
| 5,762,402 | A | | 6/1998 | Gillotti | |
| 5,800,012 | A | | 9/1998 | Ziegler | |
| 5,971,485 | A | * | 10/1999 | Clark | 297/423.12 |
| 6,065,808 | A | | 5/2000 | Tinsley | |
| 6,076,527 | A | | 6/2000 | Rottinghaus et al. | |
| 6,446,287 | B2 | * | 9/2002 | Borders | 5/618 |
| 6,619,747 | B2 | * | 9/2003 | Ko et al. | 297/423.12 |
| 6,662,392 | B2 | * | 12/2003 | Heimbrock | 5/621 |
| 6,694,548 | B2 | * | 2/2004 | Foster et al. | 5/600 |
| 6,698,431 | B1 | | 3/2004 | Harris et al. | |
| 6,729,690 | B2 | | 5/2004 | Roleder et al. | |
| 7,144,080 | B2 | | 12/2006 | Lloyd | |
| 7,171,709 | B2 | * | 2/2007 | Weismiller | 5/621 |
| 7,178,868 | B2 | | 2/2007 | Richardson et al. | |
| 7,452,032 | B1 | * | 11/2008 | Roleder et al. | 297/330 |
| 2006/0016010 | A1 | * | 1/2006 | Weismiller | 5/624 |
| 2006/0059621 | A1 | * | 3/2006 | Poulos et al. | 5/430 |
| 2006/0168727 | A1 | * | 8/2006 | Heimbrock | 5/602 |
| 2006/0225215 | A1 | * | 10/2006 | Krecow et al. | 5/649 |
| 2007/0112600 | A1 | | 5/2007 | Palmer et al. | |
| 2007/0157393 | A1 | | 7/2007 | Gerlach | |
| 2008/0132383 | A1 | | 6/2008 | Einav et al. | |
| 2008/0235875 | A1 | * | 10/2008 | Wells | 5/602 |
| 2009/0199339 | A1 | * | 8/2009 | Barr | 5/602 |
| 2010/0242176 | A1 | | 9/2010 | Newkirk et al. | |

* cited by examiner

*Primary Examiner* — William Kelleher
(74) *Attorney, Agent, or Firm* — Barnes & Thornburg LLP

(57) ABSTRACT

A person-support apparatus comprises a frame, a deck, and an upper body support assembly. The deck is coupled to the frame and configured to support a person. The deck includes a first section and a second section. The first section is configured to pivot between a first angular orientation and a second angular orientation with respect to the frame. The person is in a supine position when the first section is in the first angular orientation and is moved to a sitting position when the first section is moved to the second angular orientation. The upper body support assembly is movably coupled to the frame and includes a torso support. The torso support is configured to support a portion of the person's torso when the person is in a forward-leaning posture in the sitting position.

28 Claims, 6 Drawing Sheets

UPPER BODY SUPPORT MECHANISM

BACKGROUND OF THE DISCLOSURE

This disclosure relates generally to upper body support assemblies coupled person-support apparatuses. More particularly, but not exclusively, this disclosure relates to an upper body support assembly configured to support a portion of the upper body of a person positioned on a person-support apparatus to help provide access to a portion of the person's upper body.

Caregivers can require access to a portion of a person's body, such as, the back of the person's torso, while the person is supported on a person-support apparatus. While various person-support apparatuses have been developed, there is still room for improvement. Thus, a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the current disclosure can include an upper body support assembly coupled to a person-support apparatus and having a torso support structure configured to support the torso of a person and an arm support structure configured to support arm of the person when the person is in a forward-leaning posture in a sitting position.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DESCRIPTION OF SPECIFIC ILLUSTRATIVE EMBODIMENTS

Figure 1:
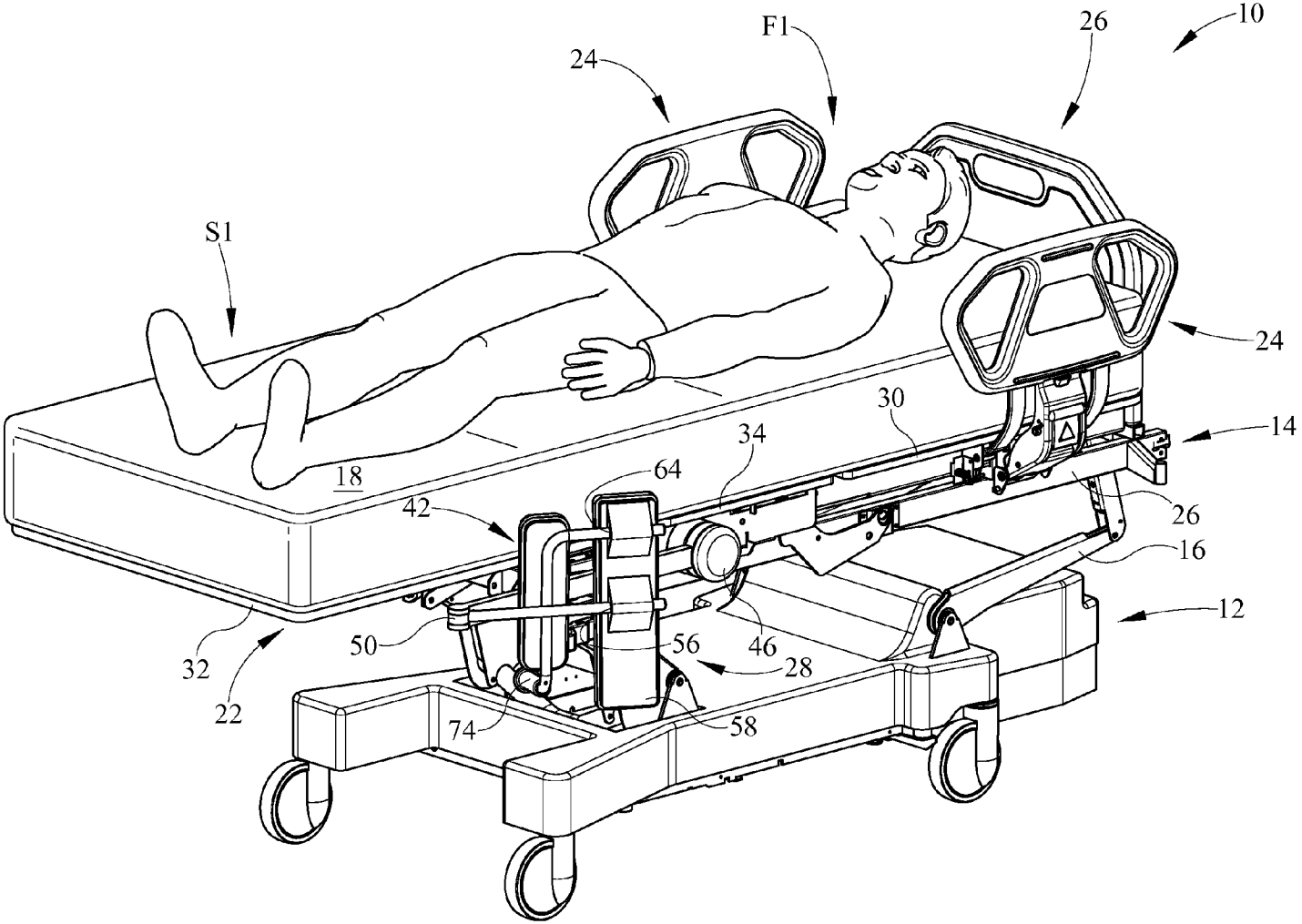
FIG. 1 is a perspective side view of a person-support apparatus with upper body support mechanisms coupled thereto in a storage position and a person supported on the deck in a supine position according to one illustrative embodiment of the disclosure.
Figure 2:
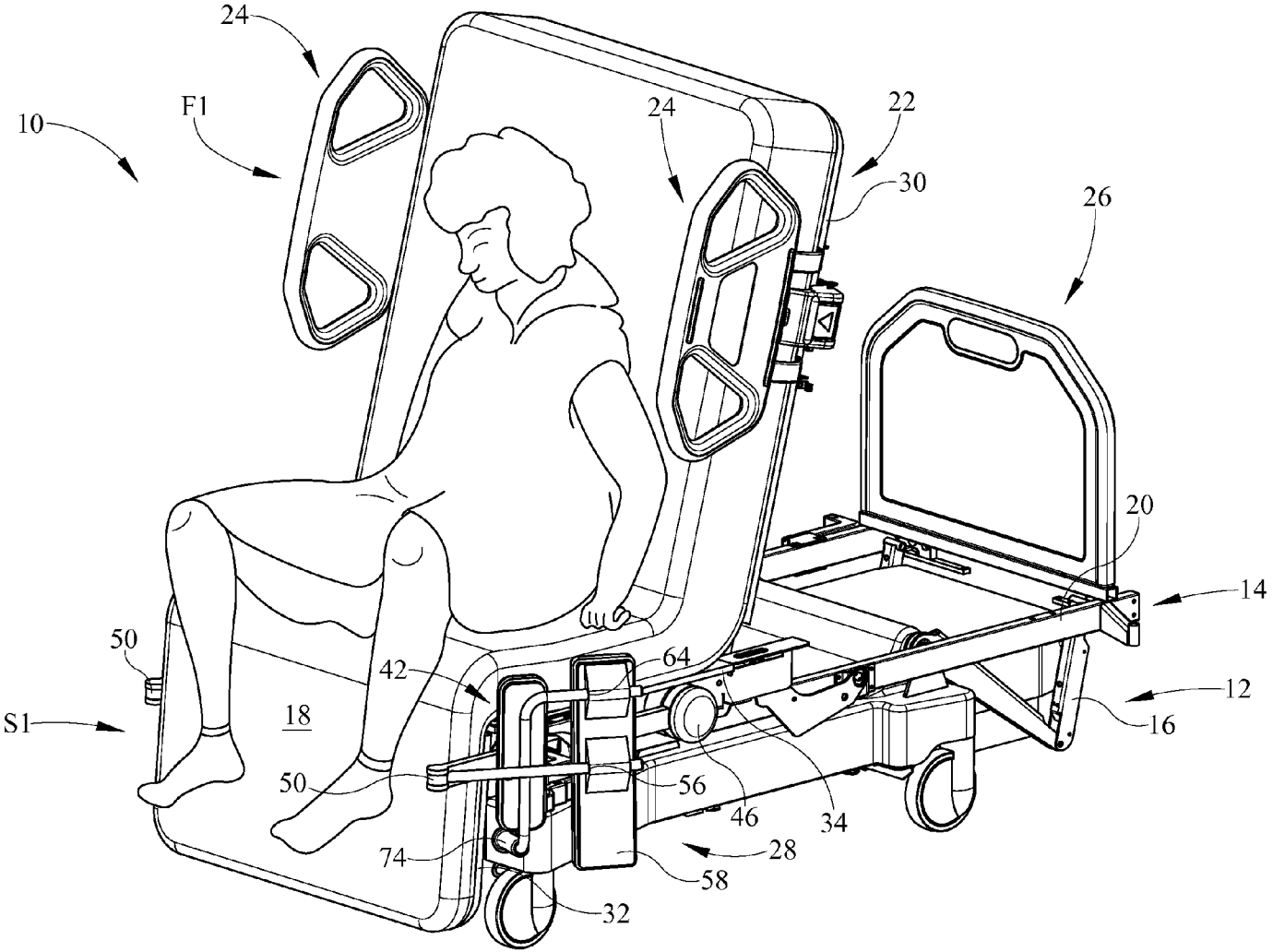
FIG. 2 is a perspective side view of the person-support apparatus of FIG. 1 showing the upper body support section of the deck in a second angular orientation supporting a person in a sitting position.
Figure 3:
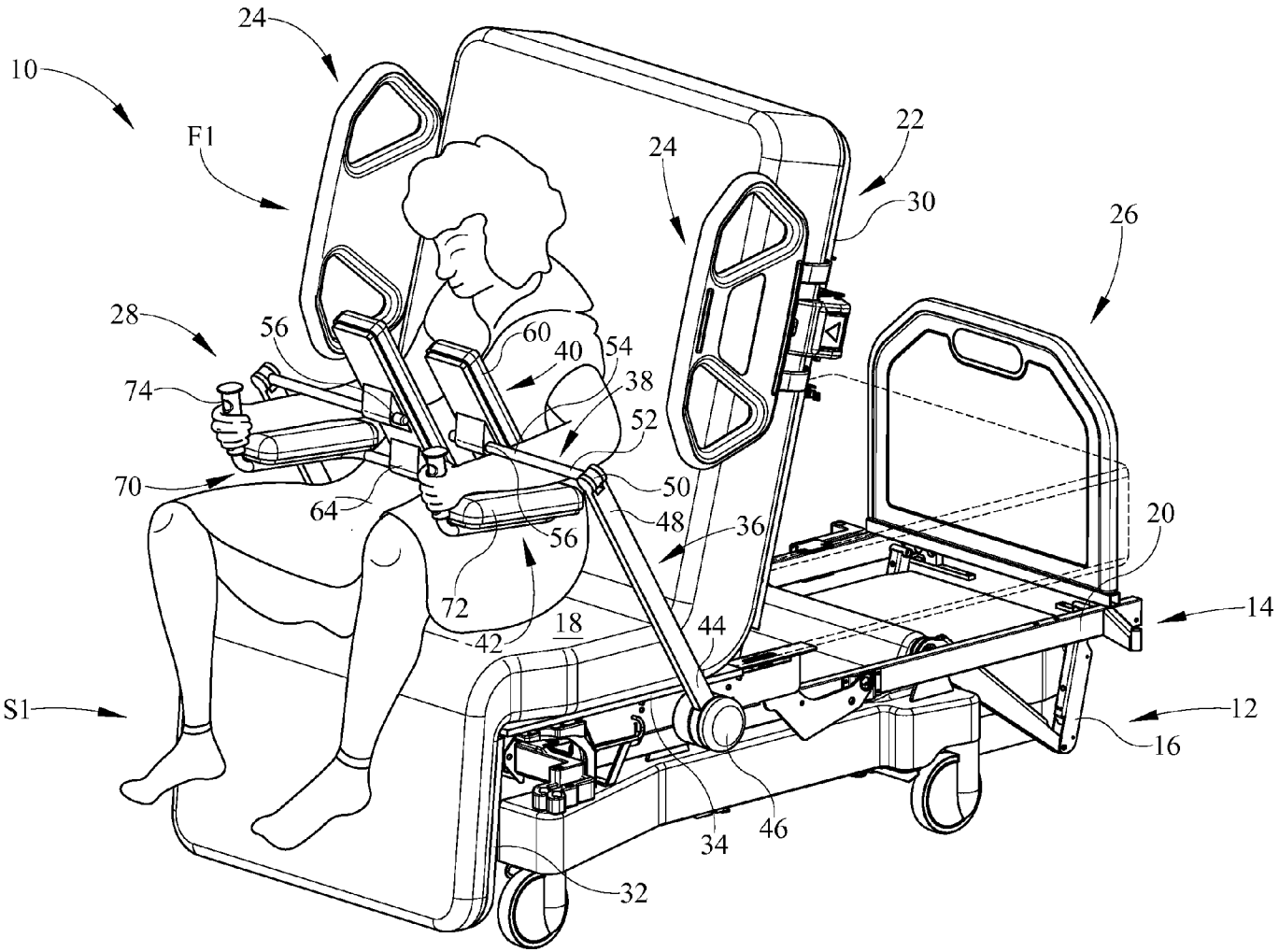
FIG. 3 is a perspective side view of the person-support apparatus of FIG. 1 showing the person in a forward-leaning posture in the sitting position supported by the upper body support mechanisms in the deployed position.
Figure 4:
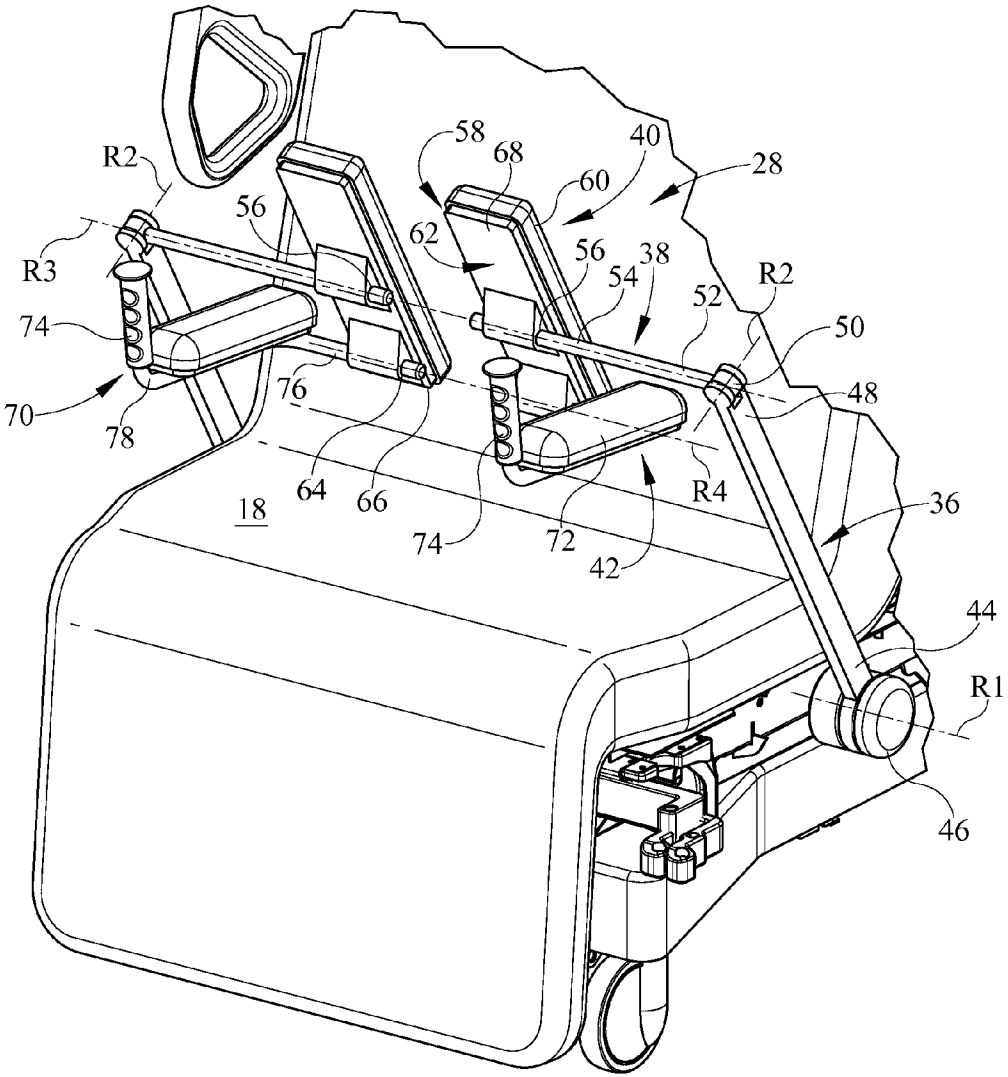
FIG. 4 is a perspective side view of the upper body support mechanisms of FIG. 1 showing the first link, the second link, the torso support structure and the limb support structure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the current disclosure can include an upper body support assembly coupled to a person-support apparatus and having a torso support structure configured to support the torso of a person and an arm support structure configured to support arm of the person when the person is in a forward-leaning posture in a sitting position.

A person-support apparatus 10 according to one illustrative embodiment of the current disclosure is shown in FIGS. 1-6. The person-support apparatus 10 is a hospital bed with a first section F1 or a head support section F1, where the head of a person (not shown) can be positioned and a second section S1 or a foot support section S1, where the feet of the person (not shown) can be positioned. The person-support apparatus 10 includes a lower frame 12 and an upper frame 14 supported on supports 16 above the lower frame 12. It should be appreciated that the person-support apparatus 10 can also be a hospital stretcher, an operating table, or other apparatus configured to support a person thereon. It should also be appreciated that, in one illustrative embodiment, the person-support apparatus 10 can support a person-support surface 18 or mattress 18 on the upper frame 14. The supports 16 are lift mechanisms configured to move the upper frame 14 with respect to the lower frame 12.

The upper frame 14 includes an upper frame base 20 and a deck 22 and has siderails 24, endboards 26, and upper body support mechanisms 28 coupled thereto as shown in FIGS. 1-5. The deck 22 can be supported on the upper frame base 20 and can include multiple sections, such as, an upper body section 30, a foot section 32, and a seat section 34. The sections can be configured to pivot and/or translate with respect to the upper frame base 20 and one another. In one illustrative embodiment, the upper body section 30 is configured to move from a first angular orientation where the upper body section 30 is a substantially horizontal position and the person is in a substantially supine position, as shown in FIG. 1, to a second angular orientation where the upper body section 30 is in an inclined position and the person is in a sitting position as shown in FIGS. 2-5. It should also be appreciated that the deck 22 is configured to cooperate with the upper frame base 20 to move the person-support apparatus 10 between a substantially horizontal position and a chair position.

The upper body support mechanisms 28 are coupled to the upper frame 14 and configured to move between a deployed position and a storage position with respect to the upper frame 14 as shown in FIGS. 1-5. In the deployed position, the upper body support mechanisms 28 are configured to support the person supported on the person-support apparatus 10 in such a way that a caregiver is able to access the back of the person's torso. In one illustrative embodiment, the person is in a forward-leaning posture in a sitting position and the torso is supported at an angle between about 0° and about 45° with respect to vertical. It should be appreciated that the angle of the upper body support mechanisms 28 with respect to vertical depend on, for example, where the upper body support mechanisms 28 are coupled to the frame and/or the size of the person. The position can allow for prolonged caregiver access to the back of the person's upper body for various procedures and can help reduce any discomfort that might be associated with proning. In one example, the position can help enhance respiratory functions by helping increase blood flow to the base of the lungs in addition to helping to remove some of the resistance to the lung expansion. In another example, the position can also be used for chest-wall oscillation therapy. In another example, the position can help reduce the amount of weight on the lungs and stomach.

Figure 5:
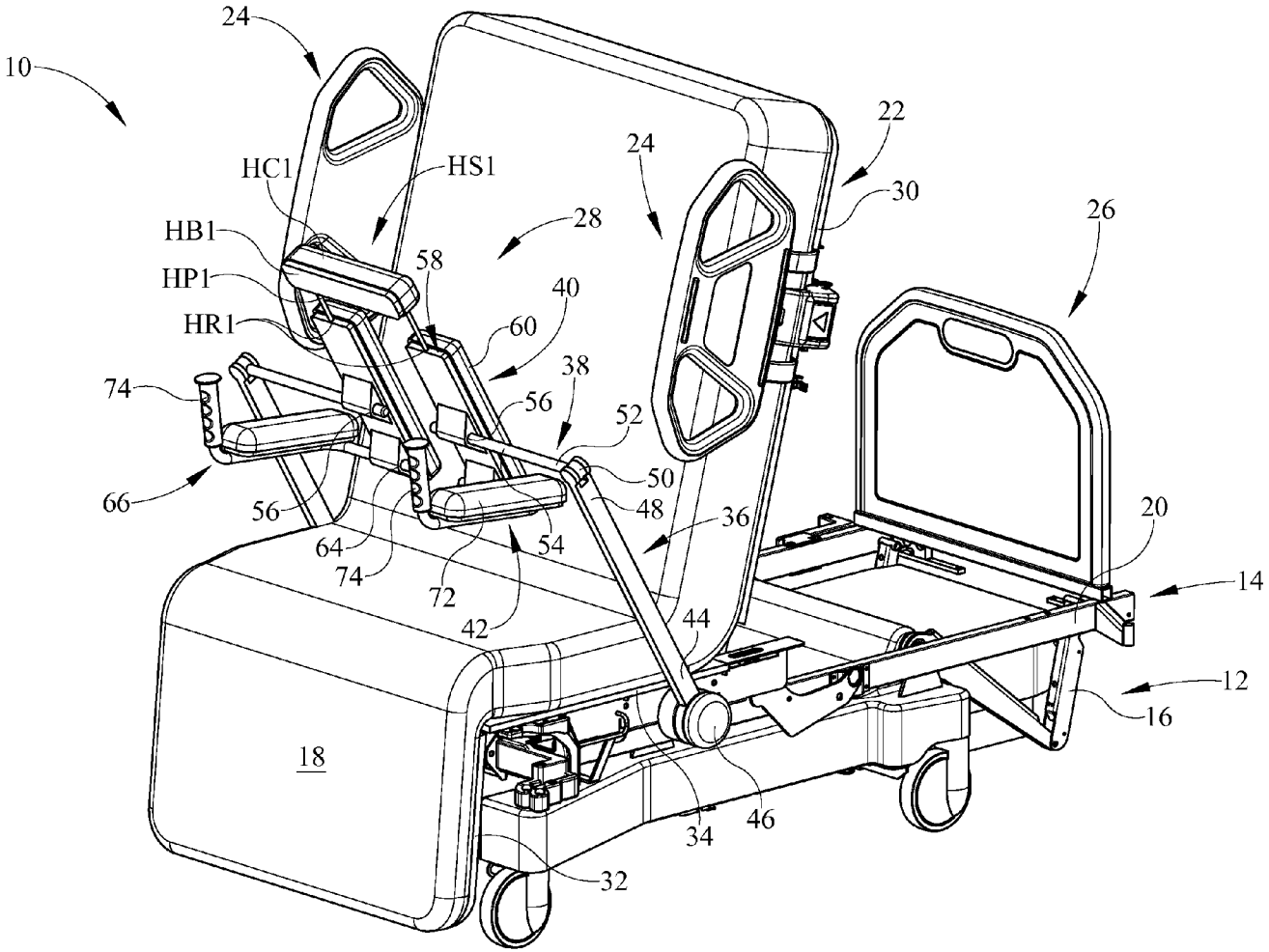
FIG. 5 is a perspective side view of the person-support apparatus of FIG. 1 showing the upper body support mechanisms according to another illustrative embodiment with a head rest coupled thereto.

The upper body support mechanisms 28 are minor images of one another and include a first link 36, a second link 38, a torso support structure 40, and a limb support structure 42 as shown in FIGS. 1-5. It should be appreciated that the upper body support mechanisms 28 can include a head support HS1 configured to support the head of the person and can include a head base HB1 with a head cushion HC1 coupled thereto and a plurality of head posts HP1 configured to be coupled to the torso support structure 40 as shown in FIG. 5. It should also be appreciated that the head posts HP1 can be a telescoping arrangement configured to increase and decrease in length of the head posts HP1 to raise and lower the height of the head support HS1 with respect to the torso support structure 40.

The first link 36 includes a first end 44 coupled to the upper frame 14 at a first joint 46 and a second end 48 coupled to the second link 38 at a second joint 50 as shown in FIGS. 1-5. It should be appreciated that the first link 36 can include a telescoping arrangement (not shown) configured to increase/decrease the length of the first link 36. The first link 36 is configured to selectively rotate about a first rotational axis R1 passing through the first joint 38 to move the upper body support mechanisms 28 between the deployed position and the storage position. It should be appreciated that the upper body support mechanisms 28 can include a locking mechanism (not shown) configured to selectively maintain the upper body support mechanisms 28 in the deployed and/or storage positions. It should also be appreciated that first link 36 can be configured to be maintained in one of multiple deployed positions that can be between about 0° and about 45° with respect to vertical. It should also be appreciated that additional locking mechanisms (not shown) can be used to restrict/maintain the positions of the second link 38, torso support structure 40, and/or limb support structure 42 with respect to one another.

The second link 38 includes a first end 52 coupled to the first link 36 at the second joint 50 and a second end 54 coupled to the torso support structure 40 at a third joint 56 as shown in FIGS. 1-5. It should be appreciated that the second link 38 can include a telescoping arrangement (not shown) configured to increase/decrease the length of the second link 38. The second link 38 is configured to rotate about a second rotational axis R2 passing through the second joint 50 to move the torso support structure 40 between a use position and a storage position with respect to the first link 36. In the deployed position, the second link 38 can be substantially perpendicular to the first link 36. The second rotational axis R2 can be substantially perpendicular to the first rotational axis R1.

The torso support structure 32 is configured to support the torso of the person thereon and includes a torso support base 58 and a torso support cushion 60 as shown in FIGS. 1-6. In one illustrative embodiment, the torso support structure 32 supports the person's chest. The torso support base 58 includes a first surface 62 and a second surface (not shown). It should be appreciated that the torso support base 58 can also include head receptacles HR1 that can be configured to receive the head support HS1 as shown in FIG. 5. The first surface 62 is coupled to the second link 38 at the third joint 56 and coupled to the limb support structure 42 at a fourth joint 64. In one illustrative embodiment, the fourth joint 64 is positioned proximate to a first end 66 of the torso support base 58 and the third joint 56 is positioned between the fourth joint 64 and a second end 68 of the torso support base 58. It should be appreciated that the third joint 56 can be spaced apart from the fourth joint 64 a distance such that a person's arm can be positioned between the second link 38 and the limb support structure 42. It should also be appreciated that the second link 38 can be coupled to the torso support base 58 at the third joint 56 and the limb support structure 42 can extend from the second link 38. The torso support structure 40 is configured to rotate with respect to the second link 38 about a third rotational axis R3 that passes through the second joint 50 and the third joint 56. It should be appreciated that the third rotational axis R3 can be substantially perpendicular to the second rotational axis R2.

The torso support cushion 60 can be coupled to the second surface of the torso support base 58 and can engage the torso of the person as shown in FIGS. 1-6. It should be appreciated that the torso support cushion 60 can be coupled to the torso support base 58 with fasteners (not shown), such as, screws or rivets. The torso support cushion 60 can be configured provide a comfortable surface for the person's torso to be supported on. The torso support cushion 60 can be composed of a polymeric material, such as, foam.

Figure 6:
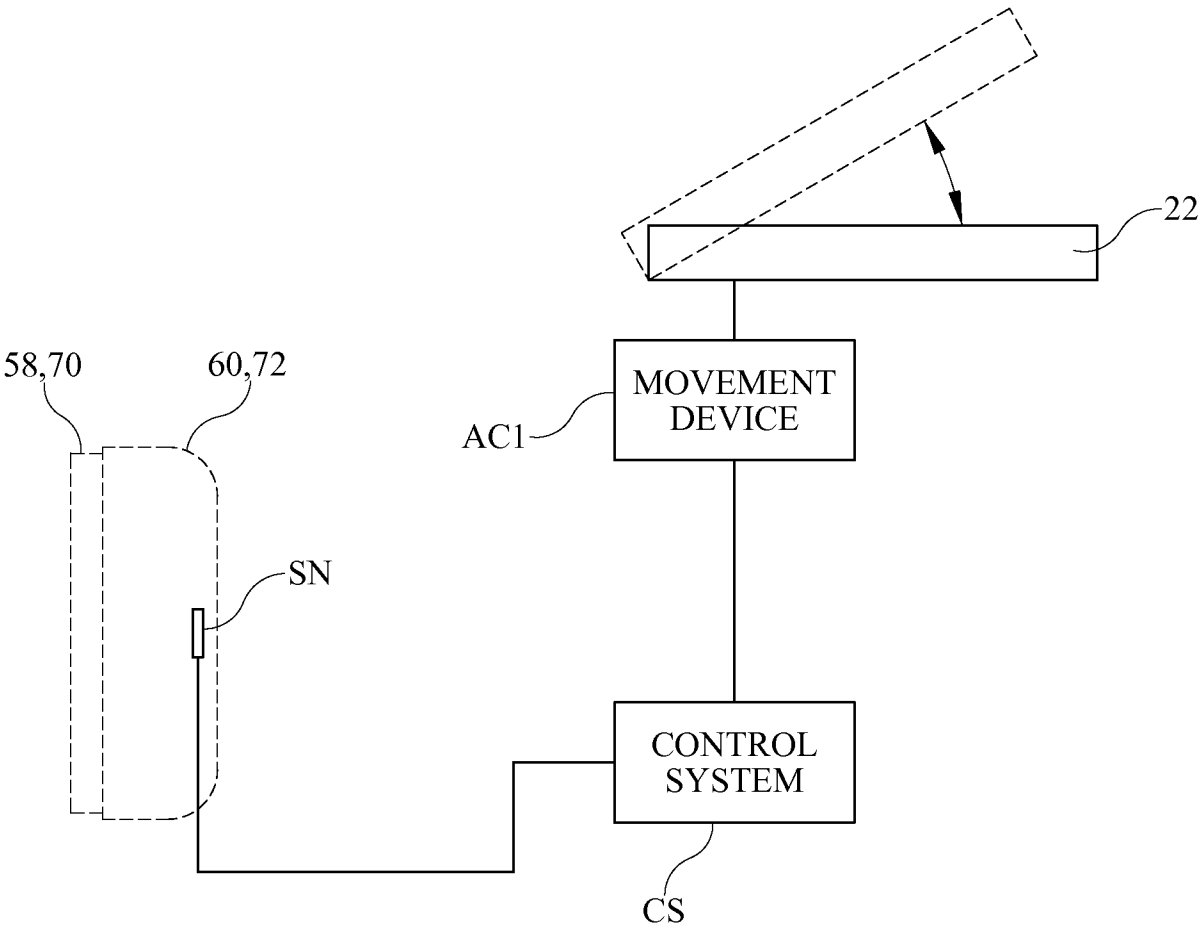
FIG. 6 is a partial diagrammatic view of the person-support apparatus of FIG. 1 having a sensor coupled to a support cushion and configured to communicate a signal to a communication system to cause the upper body support section to move toward the first angular orientation when the person is supported on the upper body support mechanisms.

In one illustrative embodiment, the torso support cushion 60 includes a sensor SN1, such as, a force sensor, configured to sense when the person is being supported by the upper body support mechanisms 28 as shown in FIG. 6. It should be appreciated that the sensor SN1 can be a torque sensor, a pressure sensor, a temperature, or other sensor. It should also be appreciated that the sensor SN1 can be a torque sensor coupled to the first joint 46. It should also be appreciated that the sensor SN1 can be coupled to the upper frame 14 and configured to sense the position, weight, and/or center of gravity of the person, which can be communicated to the control system CS1 to determine whether or not the person is supported by the upper body support mechanisms 28. The sensor SN1 can communicate a signal corresponding to whether or not the person is supported by the support mechanism 28 to a control system CS1 configured to control various functions of the person-support apparatus 10. It should be appreciated that the control system CS1 can include memory (not shown) and a processor (not shown) that can be configured to read and/or write data to the memory and execute operating logic that can be stored in the memory. In one illustrative embodiment, the control system CS1 is configured to activate a movement device, such as, an actuator AC1, coupled to the upper frame base 20 and the upper body section 30 that is configured to move the upper body section 30 of the deck 22 from the second angular orientation toward the first angular orientation when the sensor SN1 indicates that the person is supported by the upper body support mechanisms 28. In another illustrative embodiment, a caregiver can press a button (not shown) that can cause the control system CS1 to activate the movement device to move the upper body section 30 from the second angular orientation to the first angular orientation when the person is supported by the upper body support mechanisms 28. It should also be appreciated that the upper body section 30 can be manually lowered from the inclined position toward the substantially horizontal position.

The limb support structure 42 is configured to support the arm of the person and includes a limb support base 70, a limb support cushion 72, and a grip 74 as shown in FIGS. 1-5. It should be appreciated that the limb support structure 42 can include a telescoping arrangement (not shown) configured to increase/decrease the length of the limb support structure 42. The limb support base 70 includes a first end 76 coupled to the torso support structure 40 at the fourth joint 44 and a second end 78 coupled to the grip 74. The limb support base 70 is configured to rotate about a fourth rotational axis R4 that passes through the fourth joint 44 between a use position and a storage position. The fourth rotational axis R4 can be substantially parallel to the third rotational axis R3. In the use position, the limb support structure 42 can be substantially perpendicular to the second link 38. In the storage position, the limb support structure 42 can be substantially parallel to the torso support structure 40.

The limb support cushion 72 is coupled to the limb support base 70 and is engaged by the forearm of the person as shown in FIGS. 1-6. It should be appreciated that the limb support cushion 72 can be coupled to the limb support base 70 with fasteners (not shown), such as, screws or rivets. The limb support cushion 72 can be configured provide a comfortable surface for the person's arm to be supported on. The limb support cushion 72 can be composed of a polymeric material, such as, foam. In one illustrative embodiment, the limb support cushion 72 includes a sensor SN1, such as, a force sensor, configured to sense when the person is being supported by the upper body support mechanisms 28.

The grip 74 is coupled to the second end 78 of the limb support base 70 and can be configured to be gripped by a person being supported on the upper body support mechanisms 28 as shown in FIGS. 1-5. It should be appreciated that the grip 74 can be movably coupled to the second end 78. It should also be appreciated that the grip 74 can include control buttons (not shown) thereon that are configured to cause the control system CS1 to control a function of the person-support apparatus 10, such as, for example, raise/lower the upper body section 30.

In operation, the upper body section 30 is initially in the horizontal position with the person in the supine position, and the upper body support mechanisms 28 are initially in the storage position alongside the upper frame 14 such that the first link 36 is substantially parallel to the upper frame base 20 and the torso support structure 40 and the limb support structure 42 are adjacent to the seat section 30 as shown in FIG. 1. The caregiver raises the upper body section 30 from a substantially horizontal position to an inclined position with respect to the upper frame base 20 to move the person from a supine position to a sitting position. It should be appreciated that the person's chest can define an angle of less than or equal to 90° with respect to the upper frame base 20 when the person is in the sitting position.

Once the person is in the sitting position, the upper body support mechanisms 28 are moved from the storage position to the deployed position. To move the support mechanism 28 from the storage position to the deployed position, the first link 36 is rotated about the first rotational axis R1 from the storage position toward deployed position. It should be appreciated that the upper body support mechanisms 28 are between about 0° and about 45° with respect to vertical in the deployed position. Once the first link 36 is in the use position, the second link 38 is rotated about the second rotational axis R2 until the third rotational axis R3 is substantially parallel to the first rotational axis R1 and the torso support structure 36 is positioned above the seat section 34 in the use position. It should also be appreciated that the torso support structure 36 can be positioned over other portions of the deck 22 in the use position. After the torso support structure 40 is in the use position, the limb support structure 42 is moved to the use position by rotating the limb support base 70 about the fourth rotational axis R4 such that the limb support structure 42 is substantially parallel to the upper frame base 20.

Once the upper body support mechanisms 28 are fully deployed, as shown in FIGS. 2-6, the person can lean forward (or can be leaned forward by a caregiver) in the sitting position such that they are in a forward-leaning posture when supported by the upper body support mechanisms 28. In one illustrative embodiment, the control system CS1 moves the upper body section 30 from the inclined position to the substantially horizontal position once the sensors SN1 sense that the person is supported on the upper body support mechanisms 28. It should be appreciated that the caregiver can press a button (not shown) to move the upper body section 30 from the inclined position to the substantially horizontal position when the person is supported on the upper body support mechanisms 28. It should also be appreciated that the caregiver can manually move the upper body section 30 from the inclined position to the substantially horizontal position.

To move the support mechanism 28 from the deployed position to the storage position, the limb support structure 42 is moved to the storage position first by rotating the limb support structure 42 about the fourth rotational axis R4 until the limb support cushion 72 contacts the second link 38 or is immediately adjacent to the second link 38. Next, the torso support structure 40 is moved to the storage position by rotating the second link 38 about the second rotational axis R2 until the second link 38 is adjacent to the first link 36. Finally, the first link 36 is rotated about the first rotational axis R1 until the first link is alongside the upper frame 14 and is substantially parallel to the upper frame base 20 in the storage position as shown in FIG. 1.

Many other embodiments of the present disclosure are also envisioned. For example, a person-support apparatus comprises a frame, a deck, and an upper body support assembly. The deck is coupled to the frame and configured to support a person. The deck includes a first section and a second section. The first section is configured to pivot between a first angular orientation and a second angular orientation with respect to the frame. The person is in a supine position when the first section is in the first angular orientation and is moved to a sitting position when the first section is moved to the second angular orientation. The upper body support assembly is movably coupled to the frame and includes a torso support. The torso support is configured to support a portion of the person's torso when the person is in a forward-leaning posture in the sitting position.

In another example, a person-support apparatus comprises a lower frame, a lift mechanism, an upper frame, a siderail, and an upper body support assembly. The lift mechanism is coupled to the lower frame. The upper frame is movably supported above the lower frame by the lift mechanism. The siderail is coupled to the upper frame and configured to locate an edge of the upper frame. The upper body support assembly is movably coupled to the upper frame and configured to move between a storage position and a deployed position. The upper body support assembly is configured to support the chest of the person when the upper body support assembly is in the deployed position and the person is in a sitting position.

In yet another example, a person-support apparatus comprises a frame, an upper body support assembly, and a sensor. The frame is configured to support a person thereon. The upper body support assembly is movably coupled to the frame and is configured to support the upper body of the person when the person is in a sitting position. The sensor is configured to sense when the upper body of the person is being supported by the upper body support assembly.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A person-support apparatus, comprising:

a frame;

a deck coupled to the frame and configured to support a person, the deck including a first section and a second section, the first section being configured to pivot between a first angular orientation and a second angular orientation with respect to the frame, wherein the person support apparatus is configured to support the person in a substantially supine position when the first section is in the first angular orientation and is configured to support the person in a substantially sitting position when the first section is in the second angular orientation; and an upper body support assembly movably coupled to the frame and including a torso support, the torso support being configured to support a portion of the person's torso when the person is in a forward-leaning posture in the sitting position, wherein the upper body support assembly comprises first and second support structures coupled to opposing sides of the person support apparatus, the first and second support structures to converge to form a torso support at substantially the center of the bed.

2. The person-support apparatus of claim 1, wherein the upper body support assembly also includes an arm support configured to support at least a portion of the person's arm.

3. The person-support apparatus of claim 2, wherein the arm support includes a cushion coupled thereto.

4. The person-support apparatus of claim 2, wherein the arm support includes a grip configured to be gripped by the person.

5. The person-support apparatus of claim 1, wherein the torso support includes a cushion coupled thereto.

6. The person-support apparatus of claim 1, wherein the first section of the deck is manually moved from the second angular orientation to the first angular orientation when the person is supported by the upper body support assembly.

7. The person-support apparatus of claim 1, wherein the first section of the deck is configured to be automatically moved from the second angular orientation to the first angular orientation in response to the person being supported by the upper body support assembly.

8. The person-support apparatus of claim 1, wherein a button is pressed to move the first section of the deck from the second angular orientation to the first angular orientation when the person is supported by the upper body support assembly.

9. The person-support apparatus of claim 1, wherein the upper body support is configured to move with respect to the frame independent of the deck.

10. A person-support apparatus, comprising:

a lower frame;

a lift mechanism coupled to the lower frame;

an upper frame movably supported above the lower frame by the lift mechanism;

a siderail coupled to the upper frame and configured to locate an edge of the upper frame; and an upper body support assembly movably coupled to the upper frame and configured to move between a storage position and a deployed position, the upper body support assembly being configured to support the chest of the person when the upper body support assembly is in the deployed position and the person is in a sitting position, wherein the upper body support assembly comprises first and second support structures coupled to opposing sides of the person support apparatus, the first and second support structures to converge to form a torso support at substantially the center of the bed.

11. The person-support apparatus of claim 10, wherein the upper body support assembly includes a chest support configured to support the person's chest, the chest support including a cushion coupled thereto.

12. The person-support apparatus of claim 10, wherein the upper body support assembly includes an arm support configured to support at least a portion of the person's arm.

13. The person-support apparatus of claim 12, wherein the arm support includes a cushion coupled thereto.

14. The person-support apparatus of claim 12, wherein the arm support includes a grip configured to be gripped by the person.

15. The person-support apparatus of claim 10, wherein the upper body support assembly includes a head support configured to support a portion of the person's head.

16. The person-support apparatus of claim 10, wherein the upper frame includes a deck with a first section and a second section, the first section being pivotable between a first angular orientation and a second angular orientation with respect to the second section, the first section being configured to support a person in a supine position in the first angular orientation and move the person from the supine position to the sitting position as the first section moves to the second angular orientation.

17. The person-support apparatus of claim 10, wherein the person is in a forward-leaning posture in the sitting position when supported by the upper body support assembly.

18. A person-support apparatus, comprising:

a frame configured to support a person thereon;

an upper body support assembly movably coupled to the frame and being configured to support the upper body of the person when the person is in a sitting position, wherein the upper body support assembly comprises first and second support structures connected to opposing sides of the person support apparatus, the first and second support structures to converge to form a torso support at substantially the center of the bed; and a sensor configured to sense when the upper body of the person is being supported by the upper body support assembly.

19. The person-support apparatus of claim 18 further comprising a deck movably coupled to the frame, the deck including a first section and a second section, the first section being configured to pivot between a first angular orientation and a second angular orientation with respect to the frame, the person support apparatus being configured to support the person in a substantially supine position when the first section is at about the first angular orientation with respect to the frame and in a substantially sitting position when the first section is at about the second angular orientation with respect to the frame.

20. The person-support apparatus of claim 19, wherein the first section is configured to be moved from the second angular orientation to the first angular orientation in response to the sensor sensing that the upper body of the person is supported by the upper body support assembly.

21. The person-support apparatus of claim 18, wherein the upper body support assembly includes a chest support configured to support the person's chest.

22. The person-support apparatus of claim 18, wherein the upper body support assembly includes an arm support configured to support the person's arms.

23. The person-support apparatus of claim 18, wherein the upper body support assembly includes a head support configured to support a portion of the person's head.

24. The person-support apparatus of claim 18, wherein the upper body support assembly includes at least one of a torso support, an arm support, and a head support, the sensor is coupled to the at least one of the torso support, the arm support, and the head support.

25. The person-support apparatus of claim 18, wherein the upper body support assembly includes at least one of a torso support, an arm support, and a head support, the at least one of the torso support, the arm support, and the head support includes a cushion coupled thereto.

26. The person-support apparatus of claim 25, wherein the sensor is coupled to the cushion.

27. The person-support apparatus of claim 18, wherein the upper body support assembly is rotatably coupled to the frame at a first joint, the sensor being coupled to the first joint.

28. The person-support apparatus of claim 18, wherein the upper body support assembly and the person support apparatus support the person when the person is in a forward-leaning posture in the sitting position.

* * * * *